US007605795B2

(12) United States Patent
Thomas et al.

(10) Patent No.: US 7,605,795 B2
(45) Date of Patent: Oct. 20, 2009

(54) POWER EFFICIENT SCREENS THROUGH DISPLAY SIZE REDUCTION

(75) Inventors: Vishal Thomas, Bangalore (IN); Prasanna Desai, Bangalore (IN)

(73) Assignee: Intel Corporation, Santa Clara, CA (US)

( * ) Notice: Subject to any disclaimer, the term of this patent is extended or adjusted under 35 U.S.C. 154(b) by 581 days.

(21) Appl. No.: 11/471,794

(22) Filed: Jun. 21, 2006

(65) Prior Publication Data

US 2007/0296684 A1 Dec. 27, 2007

(51) Int. Cl.
*G09G 3/36* (2006.01)

(52) U.S. Cl. ..... 345/102

(58) Field of Classification Search ..... 345/102
See application file for complete search history.

(56) References Cited

U.S. PATENT DOCUMENTS

| | | | | |
|---|---|---|---|---|
| 7,154,468 | B2 * | 12/2006 | Linzmeier et al. | 345/102 |
| 2003/0169247 | A1 * | 9/2003 | Kawabe et al. | 345/204 |
| 2006/0170822 | A1 * | 8/2006 | Baba et al. | 348/500 |

* cited by examiner

*Primary Examiner*—Amr Awad
*Assistant Examiner*—Jonathan Boyd
(74) *Attorney, Agent, or Firm*—Buckley, Maschoff & Talwalkar LLC

(57) ABSTRACT

According to some embodiments, an apparatus, a system and a method are provided to reduce a backlit area of a display screen and resize an image to fit in the backlit area.

23 Claims, 4 Drawing Sheets

POWER EFFICIENT SCREENS THROUGH DISPLAY SIZE REDUCTION

BACKGROUND

The number of mobile devices such as laptops, personal data assistants ("PDAs"), and cell phones continue to increase as society becomes more dependent on the use of mobile devices and the batteries that power these devices. There is a need to power these mobile devices for longer periods of time such that data may not get lost for a lack of power. Since battery power is the most common form of power used by mobile devices, during periods of critical use a possibility exists that the battery may run out of power.

A large portion of power consumption for a mobile device may be due to a display system. In some cases, a device may dim a display to reduce the power required to run the device. Note that even a dimmed display may consume up to one-fifth of the device's power.

DETAILED DESCRIPTION

The several embodiments described herein are solely for the purpose of illustration. Embodiments may include any currently or hereafter-known versions of the elements described herein. Therefore, persons in the art will recognize from this description that other embodiments may be practiced with various modifications and alterations.

Figure 1:
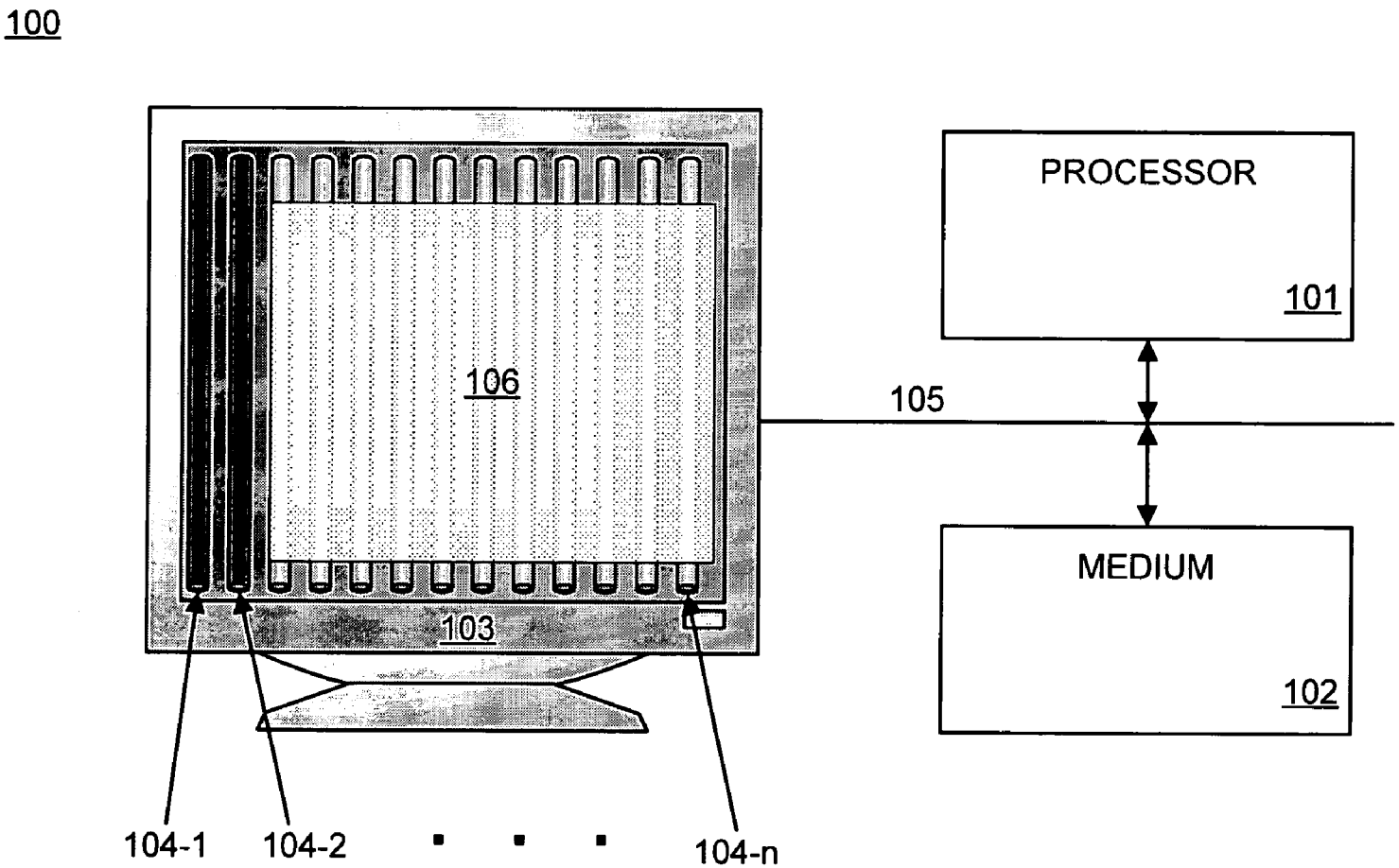
FIG. 1 is a block diagram of an apparatus according to some embodiments.

Referring now to FIG. 1, an embodiment of an apparatus 100 is shown. The apparatus may contain a display device 103, a processor 101, a bus 105, and a medium 102. The processor 101 may execute instructions stored in the medium 102. The display 103 may contain a plurality of backlight lamps 104-1 to **104-*n*. Each backlight lamp may provide the backlighting required for the display device 103. In some embodiments, the display 103 may be a liquid crystal diode ("LCD") display, but the display 103 may be any display that utilizes backlight lamps or an equivalent thereof. In one example, the plurality of backlight lamps 104-1 to 104-*n* may run vertically along the display 103**. However, the backlight lamps might also run, but are not limited to, a horizontal orientation, a diagonal orientation, and combinations thereof.

When the processor 101 determines that a predetermined amount (e.g. a predetermined percentage) of power remains, one or more backlight lamps 104-1 to **104-*n* may be turned off to conserve power while the remaining backlight lamps 104-1 to 104-*n* may remain lit. In response to the one or more backlight lamps 104-1 to 104-*n* being turned off, a desktop screen 106 may be compressed to fit in a backlit area of the display. The desktop screen 106 may be any graphical user interface display or non-graphical display. As illustrated in FIG. 1, an example is shown where backlight lamps 104-1, and 104-2 have been turned off leaving the remaining backlight lamps to provide a backlit area and the desktop screen 106** has been compressed to fit in the backlit area. The power source may be any available power source such as, but not limited to, a battery. Reducing the area of a backlit screen may sustain power levels for a greater period of time than conventional methods.

In some embodiments, A user may determine a percentage of power remaining that will trigger a reduction of the backlit area. When a trigger level is reached, a user may be prompted to accept the new resized screen or the user may decline to resize the screen. In some embodiments, a user may set multiple predetermined levels thus defining multiple predefined trigger levels. The user may also determine the percentage of backlight lamps turned off when a trigger level is reached.

For example, a user may determine that a backlit area may be reduced by 10% of its full size when a first predetermined trigger level of 65% remaining power is reached. The user may also determine that a backlit area may be reduced by 20% of its full size when a second predetermined trigger level of 30% remaining power is reached. The user may also determine that a backlit area may be reduced by 50% when a third predetermined trigger level of 10% remaining power is reached. At each of these remaining power levels, the user may decide to accept or reject the reduction of backlight area.

Figure 2:
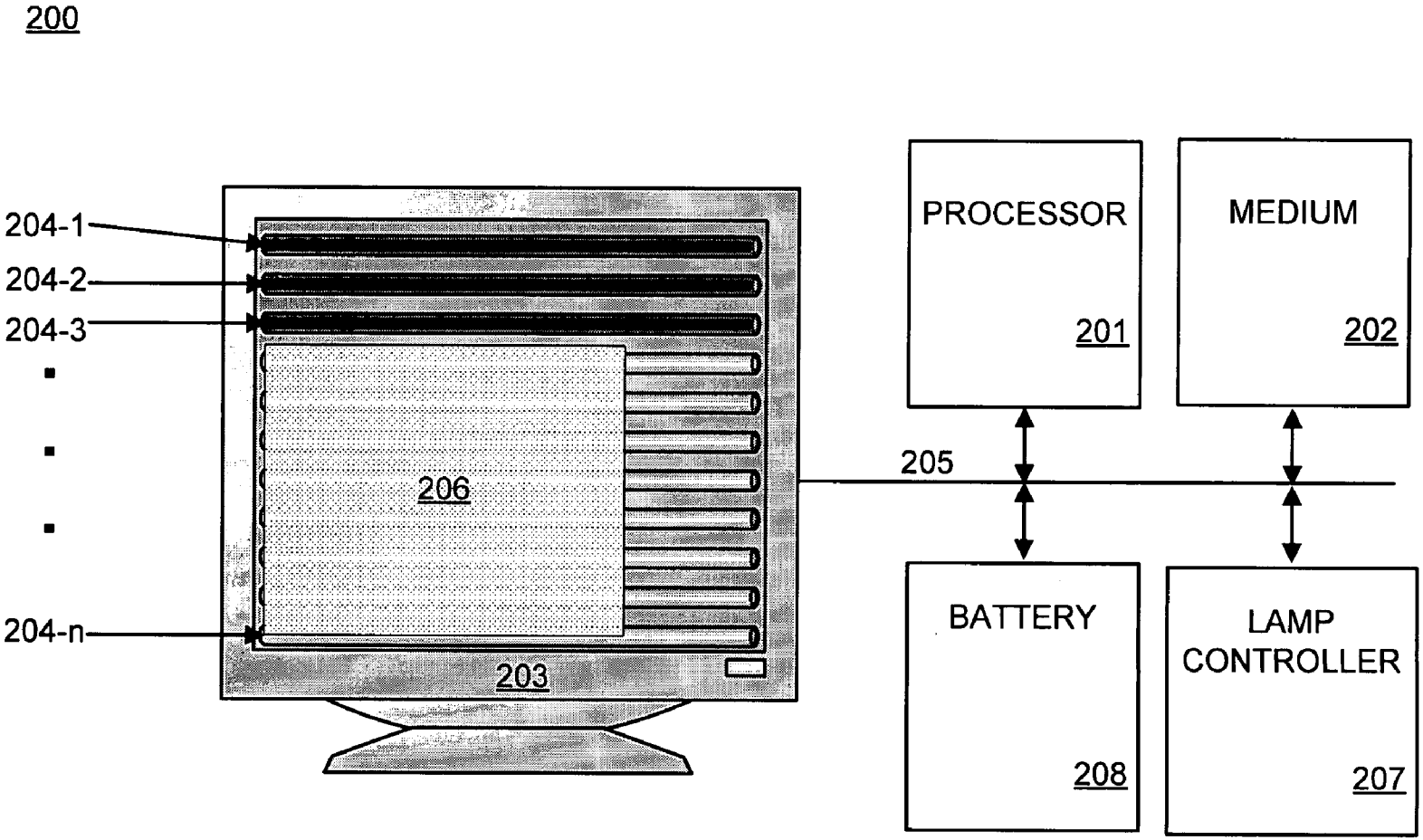
FIG. 2 is a block diagram of an system according to some embodiments.

Referring now to FIG. 2, an embodiment of a system 200 is shown. The system may contain a display device 203, a processor 201, a bus 205, a battery 208, a lamp controller 207, and a medium 202. The processor 201 may execute instructions stored in the medium 202. The display 203 may contain a plurality of backlight lamps 204-1 to **204-*n*. Each backlight lamp may provide the light required for the display device 203. In some embodiments, the display 203 may be a LCD display. The lamp controller 207** may be, for example, implemented in hardware, software, or firmware.

When the processor 201 determines that a predetermined percentage of the battery 208 remains, one or more backlight lamps 204-1 to **204-*n* may be turned off by the lamp controller 207 to conserve power. In response to the one or more backlight lamps 204-1 to 204-*n* being turned off, a desktop screen 206 may be compressed to fit in a backlit area of the display. The desktop screen 206 may be any graphical user interface display or non-graphical display. As illustrated in FIG. 2, an example is shown where backlight lamps 204-1, 204-2, and 204-3 have been turned off leaving the remaining backlight lamps to provide a backlit area and the desktop screen 206 may be compressed to fit in the backlit area. In some cases, the remaining (lit) lamps may be dimmed to save additional power. In some cases, the desktop screen 206 may not be resized or only one axis of the desktop screen 206** may be resized. Reducing the area of a backlit screen may sustain the battery power level for a greater period of time than conventional methods.

A user may determine the percentage of power remaining to trigger a reduction of the backlit area. When a trigger level is reached, a user may be prompted to accept the new resized screen or the user may decline to resize the screen. In some embodiments, a user may set multiple predetermined levels thus defining multiple predefined trigger levels. The user may also determine the percentage of backlight lamps turned off when a trigger level is reached.

Figure 3:
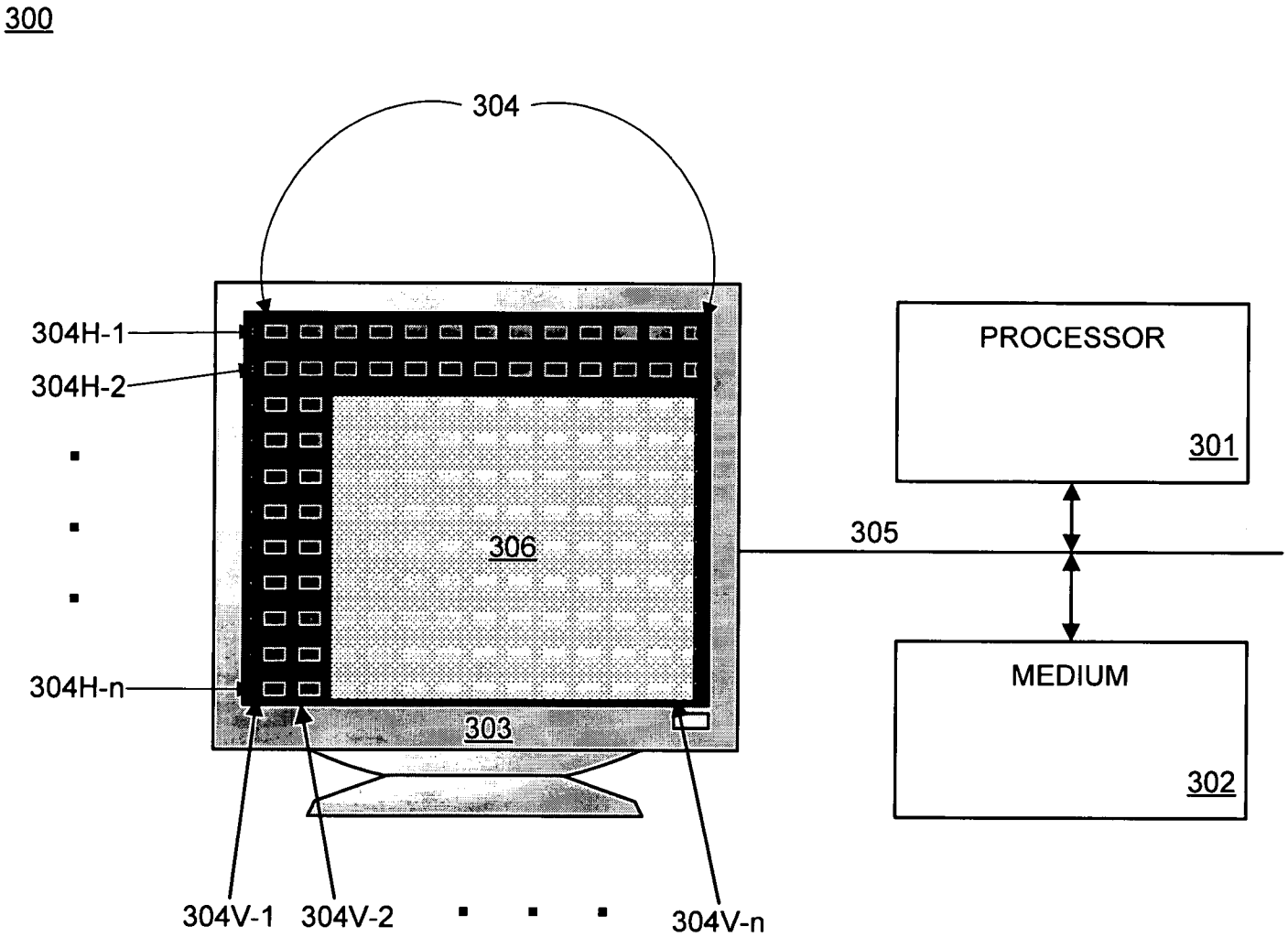
FIG. 3 is a block diagram of an apparatus according to some embodiments.

Referring now to FIG. 3, an embodiment of an apparatus 300 is shown. The apparatus may contain a display device 303, a processor 301, a bus 305, and a medium 302. The processor 301 may execute instructions stored in the medium 302. The display 303 may contain a plurality of backlight lamps 304 in a grid-like pattern. The grid-like pattern may have horizontal rows 304H-1 to 304H-n and vertical rows 304V-1 to 304V-n. Each backlight lamp 304 may provide the light required for the display device 303. In some embodiments, the display 303 may be a LCD display, however, the display 303 may be any display that utilizes backlight lamps or the equivalent thereof.

When the processor 301 determines that a predetermined percentage of power remains, one or more backlight lamps 304 having both a horizontal and a vertical component may be turned off to conserve power. In response to the one or more backlight lamps 304 being turned off, a desktop screen 306 may be compressed to fit in a backlit area of the display. As illustrated in FIG. 3, an example is shown where backlight lamps in rows 304H-1 and 304H-2 and backlight lamps in columns 304V-1 and 304V-2 have been turned off leaving the remaining backlight lamps to provide a backlit area and the desktop screen 306 has been compressed to fit in the backlit area. Note that the number of horizontal lamps turned off might not equal the number of vertical lamps turned off. The power source may be any available power source such as, but not limited to, a battery.

A user may determine the percentage of power remaining to trigger a reduction of the backlit area. When a trigger level is reached, a user may be prompted to accept the new resized screen or the user may decline to resize the screen. In some embodiments, a user may set multiple predetermined levels thus defining multiple predefined trigger levels. The user may also determine the percentage of backlight lamps turned off when a trigger level is reached.

Figure 4:
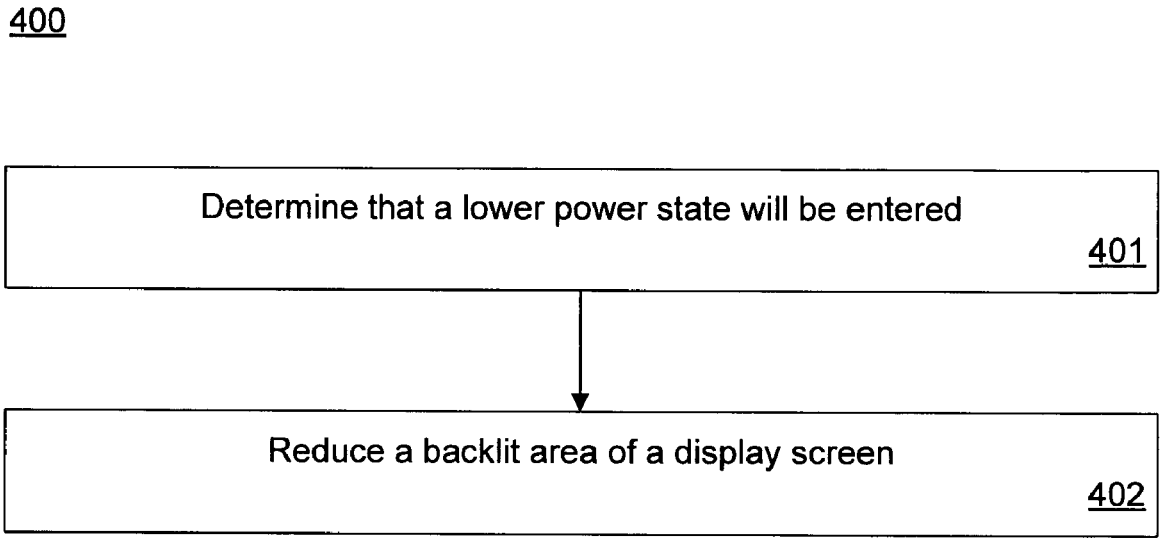
FIG. 4 is a block diagram of a method according to some embodiments.

Referring now to FIG. 4, an embodiment of a method 400 is shown. The method may be performed by, but is not limited to, a processor or a lamp controller. At 401, a determination is made that a lower power state may be entered thus a predetermined power level has reached a trigger level. A user may determine the percentage of power remaining to trigger a reduction of the backlit area. When a trigger level is reached, a user may be prompted to accept the new resized screen or the user may decline to resize the screen. In some embodiments, a user may set multiple predetermined levels thus defining multiple predefined trigger levels. The user may also determine a number or percentage of backlight lamps that will be turned off when a trigger level is reached. In some embodiments, the method 400 may be an automatic process and not user defined.

At 402, a backlit area of a display screen is reduced by a predetermined amount. When a processor determines that a predetermined percentage of power remains, one or more backlight lamps may be turned off to conserve power. In response to the one or more backlight lamps being turned off, a desktop screen may be compressed to fit in a backlit area of the display. The power source may be any available power source such as, but not limited to, a battery.

The foregoing disclosure has been described with reference to specific exemplary embodiments thereof. It will, however, be evident that various modifications and changes may be made thereto without departing from the broader spirit and scope set forth in the appended claims. For example, although a computer monitor is illustrated other display devices might be associated with any of the embodiments described herein (e.g. a wireless telephone, a PDA, a laptop computer). Also for example, the display itself may perform the aforementioned method based on a signal from a processor (e.g. lower power state or amount of power remaining).

What is claimed is:

1. An apparatus comprising:

a processor;

a plurality of backlight lamps, wherein the backlight lamps illuminate a display screen;

a medium storing instructions adapted to be executed by the processor to perform a method, the instructions comprising:

instructions to determine that a first predetermined amount of power is remaining in a battery;

instructions to reduce a full sized backlit area of the display screen by a first percentage, wherein the first percentage is less than 100% and greater than 0%, and wherein reducing is by turning off a portion of the plurality of backlight lamps in response to the determination that the first predetermined amount of power remains; and instructions to resize an image to fit in the reduced backlit area on the display screen in response to the determination that the first predetermined amount of power remains.

2. The apparatus of claim 1, further comprising:

instructions to determine that a second predetermined amount of power is remaining in a battery;

instructions to further reduce the full sized backlit area of the display screen by a second percentage wherein the second percentage is less than 100% and greater than 0%, wherein the second percentage is greater than the first percentage, and wherein reducing is by turning off a portion of the plurality of backlight lamps in response to the determination that the second predetermined amount of power remains; and instructions to resize the image to fit in the further reduced backlit area on the display screen in response to the determination that the second predetermined amount of power remains, wherein to reduce a backlit area is in response to a resized screen user verification, and wherein the plurality of backlight lamps are battery powered.

3. The apparatus of claim 2, wherein the plurality of backlight lamps are horizontal.

4. The apparatus of claim 2, wherein the plurality of backlight lamps are vertical.

5. The apparatus of claim 2, wherein the plurality of backlight lamps comprise:

a first portion wherein the backlight lamps are horizontal; and a second portion wherein the backlight lamps are vertical.

6. The apparatus of claim 1, wherein the instructions to resize an image to fit in the reduced backlit area on the display screen is in further response to the turning off of the portion of the plurality of backlight lamps.

7. The apparatus of claim 6, wherein the user defines at least one of, the defined power level, an amount of vertical reduction, or an amount of horizontal reduction.

8. The apparatus of claim 6, wherein instructions adapted to be executed by the processor are executed at a second defined power level.

9. The apparatus of claim 1, wherein the display screen is a liquid crystal diode screen.

10. The apparatus of claim 1, wherein the processor and the medium storing instructions are contained in a mobile device.

11. A method comprising:

determining that a first predetermined amount of power is remaining in a battery;

reducing a full sized backlit area of a display screen by a first percentage, wherein the first percentage is less than 100% and greater than 0%, and wherein reducing is by turning off a portion of a plurality of backlight lamps in response to the determination that the first predetermined amount of power remains; and resizing an image to fit in the reduced backlit area on the display screen in response to the determination that the first predetermined amount of power remains.

12. The method of claim 11, further comprising:

determining that a second predetermined amount of power is remaining in a battery;

reducing the full sized backlit area of the display screen by a second percentage wherein the second percentage is less than 100% and greater than 0%, wherein the second percentage is greater than the first percentage, and wherein reducing is by turning off a portion of the plurality of backlight lamps in response to the determination that the second predetermined amount of power remains; and resizing the image to fit in the further reduced backlit area on the display screen in response to the determination that the second predetermined amount of power remains wherein reducing a backlit area is in response to a resized screen user verification, and wherein the plurality of backlight lamps are battery powered.

13. The method of claim 12, wherein the plurality of backlight lamps run horizontally along the display.

14. The method of claim 12, wherein the plurality of backlight lamps run vertically along the display.

15. The method of claim 12, wherein the plurality of backlight lamps comprise:

a first portion wherein the backlight lamps run horizontally along the display; and a second portion wherein the backlight lamps run vertically along the display.

16. The method of claim 11, wherein resizing an image to fit in the reduced backlit area on the display screen is in farther response to the turning off of the portion of the plurality of backlight lamps.

17. The method of claim 16, wherein the user defines at least one of, the defined power level, an amount of vertical reduction, and an amount of horizontal reduction.

18. The method of claim 16, wherein a second reducing and a second resizing occur at a second defined power level.

19. The method of claim 11, wherein the mobile device display screen is a liquid crystal diode screen.

20. A system comprising:

a battery;

a processor;

a plurality of backlight lamps, wherein the backlight lamps illuminate a display screen;

a lamp controller to reduce a portion of a backlit area of the display screen; and a medium storing instructions adapted to be executed by the processor to perform a method, the method comprising:

determining that a first predetermined amount of power is remaining in the battery;

reducing a fall sized backlit area of the display screen by a first percentage wherein the first percentage is less than 100% and greater than 0%, and wherein reducing is by turning off a portion of the plurality of backlight lamps in response to the determination that the first predetermined amount of power remains; and resizing an image to fit in the reduced backlit area on the display screen in response to the determination that the first predetermined amount of power remains.

21. The system of claim 20, farther comprising:

determining that a second predetermined amount of power is remaining in a battery;

reducing the full sized backlit area of the display screen by a second percentage wherein the second percentage is less than 100% and greater than 0%, wherein the second percentage is greater than the first percentage, and wherein reducing is by turning off a portion of the plurality of backlight lamps in response to the determination that the second predetermined amount of power remains; and resizing the image to fit in the further reduced backlit area on the display screen in response to the determination that the second predetermined amount of power remains wherein to reduce a portion of a backlit area is in response to a resized screen user verification, and wherein the plurality of backlight lamps are battery powered.

22. A medium storing instructions adapted to be executed by a processor to perform a method, the method comprising:

determining that a first predetermined amount of power is remaining in a battery;

reducing a fall sized backlit area of a display screen by a first percentage wherein the first percentage is less than 100% and greater than 0%, and wherein reducing is by turning off a portion of a plurality of backlight lamps in response to the determination that the first predetermined amount of power remains;

resizing an image to fit in the reduced backlit area on the display screen in response to the determination that the first predetermined amount of power remains;

determining that a second predetermined amount of power is remaining in a battery;

reducing the full sized backlit area of the display screen by a second percentage wherein the second percentage is less than 100% and greater than 0%, wherein the second percentage is greater than the first percentage, and wherein reducing is by turning off a portion of the plurality of backlight lamps in response to the determination that the second predetermined amount of power remains; and resizing the image to fit in the further reduced backlit area on the display screen in response to the determination that the second predetermined amount of power remains.

23. The medium of claim 22, wherein reducing a backlit area is in response to a resized screen user verification, and wherein the plurality of backlight lamps are battery powered.

* * * * *